US006283796B1

(12) United States Patent
Yeh

(10) Patent No.: US 6,283,796 B1
(45) Date of Patent: Sep. 4, 2001

(54) RJ-RECEPTACLE CONNECTOR WITH ANTI-INCORRECT-INSERTION DEVICE

(75) Inventor: Joel Jyh-Haur Yeh, San Gabrie, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/536,165

(22) Filed: Mar. 23, 2000

(51) Int. Cl.[7] ..... H01R 13/64
(52) U.S. Cl. ..... 439/677; 439/676
(58) Field of Search ..... 439/677, 680, 439/681, 676

(56) References Cited

U.S. PATENT DOCUMENTS 6,022,246 * 2/2000 Ko ..... 439/680
6,106,335 * 2/2000 Merchant et al. ..... 439/676

* cited by examiner

*Primary Examiner*—Gary F. Paumen
(74) *Attorney, Agent, or Firm*—Wei Te Chung

(57) ABSTRACT

A RJ-receptacle connector with anti-incorrect-insertion device comprises a housing defining a receiving space for electrically receiving a complementary plug connector therein. A terminal insert is adapted to be arranged to the housing and includes a plurality of terminals integrally formed thereof. Each terminal includes a contact portion extending into the receiving space, and a solder tail extends downward from a bottom face of the housing. Anti-incorrect-insertion device is arranged in an entrance of the receiving space and blocking insertion of other connectors except the complementary plug connector.

1 Claim, 6 Drawing Sheets

RJ-RECEPTACLE CONNECTOR WITH ANTI-INCORRECT-INSERTION DEVICE

FIELD OF THE INVENTION

The present invention relates to a connector, and more particularly to a RJ receptacle connector with an anti-incorrect-insertion device therein for blocking insertion of any other connectors except a complementary connector.

DESCRIPTION OF THE PRIOR ART

RJ-45 plug and receptacle connectors have larger dimension than RJ-11 plug and receptacle connectors. As a matter of fact, the RJ-11 plug connector is possible inserted into the RJ-45 receptacle connector. The incorrect insertion of the RJ-11 plug connector into the RJ-45 receptacle connector will damage terminals within the RJ-45 receptacle connector, thus needless to say other possible electrical damages. U.S. Pat. No. 6,022,246 discloses an arrangement of another type connectors for preventing mis-mating of a smaller dimensioned plug connector with a larger dimensioned receptacle connector.

SUMMARY OF THE INVENTION

An object of the present invention is to provide a RJ-receptacle connector having an anti-incorrect-insertion device therein for blocking insertion of any other connectors except a complementary connector.

In order to achieve the object set forth, a RJ-receptacle connector with anti-incorrect-insertion device in accordance with the present invention comprises a housing defining a receiving space for electrically receiving a complementary plug connector therein. A terminal insert is adapted to be arranged to the housing and includes a plurality of terminals integrally formed thereof. Each terminal includes a contact portion extending into the receiving space, and a solder tail extends downward from a bottom face of the housing. Anti-incorrect-insertion device including a base and a blocking bar is arranged in an entrance of the receiving space and blocking insertion of other connectors except the complementary plug connector.

According to one aspect of the present invention, the blocking bar includes a reinforced bar integrally attached to the blocking bar to increase rigidity thereof.

According to another aspect of the present invention, the blocking bar includes a front face for blocking entrance of other plug connector.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
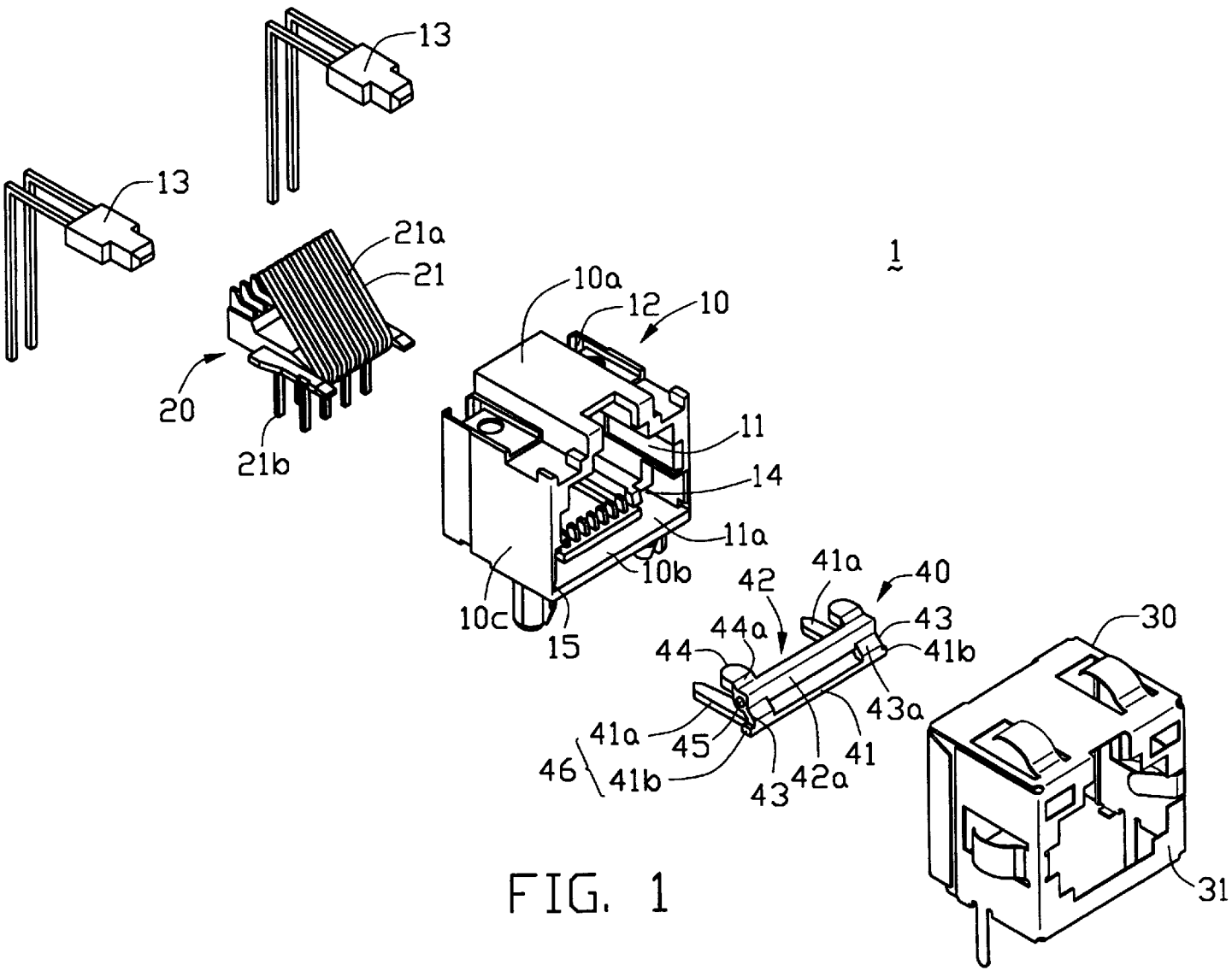
FIG. 1 is an exploded view of a RJ-receptacle connector in accordance with the present invention.
Figure 2:
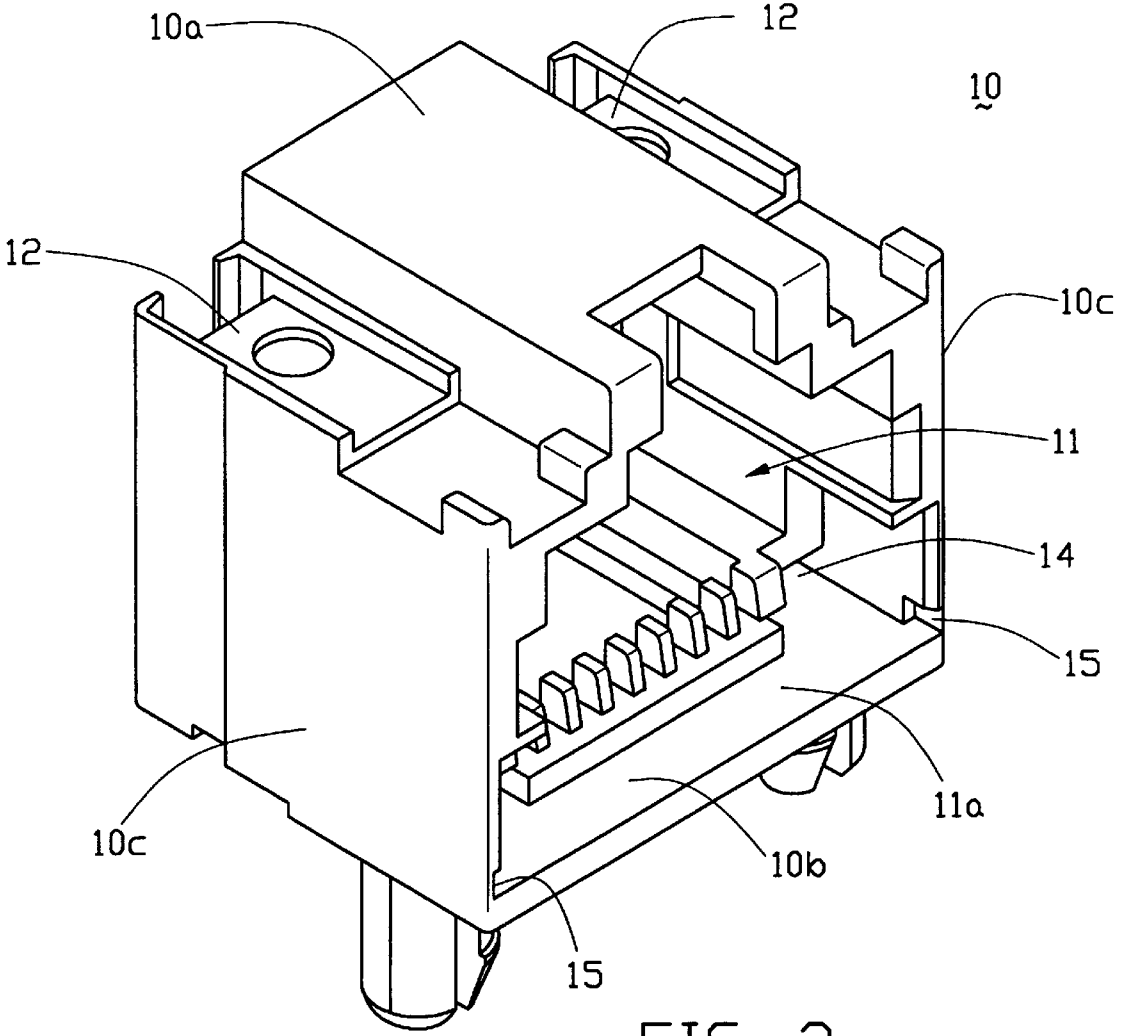
FIG. 2 is a perspective view of a receptacle connector housing in FIG. 1.
Figure 3:
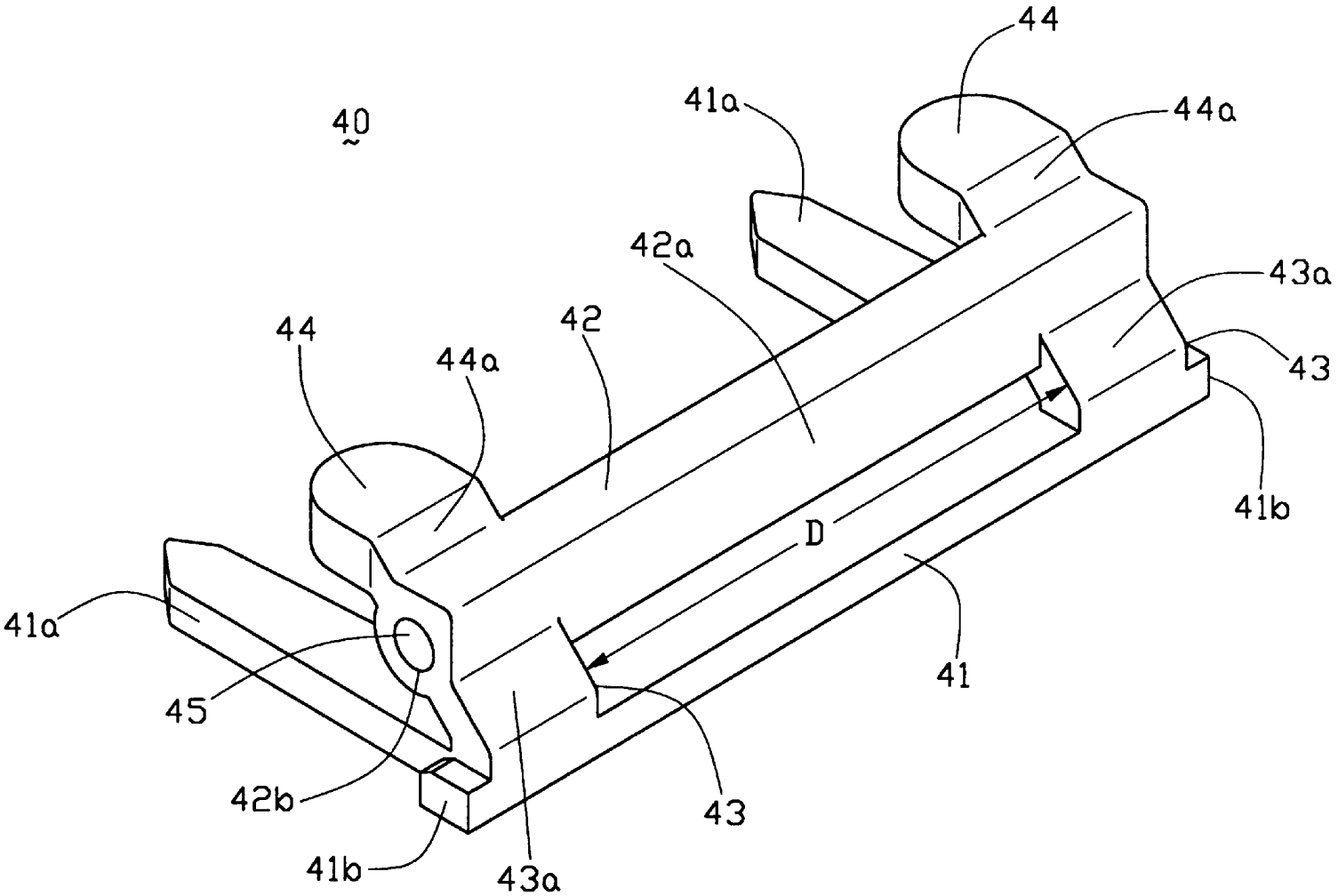
FIG. 3 is a perspective view of an anti-incorrect-insertion device in accordance with the present invention.

Referring to FIG. 1, a RJ-45 receptacle connector 1 with an anti-incorrect-insertion device 40 in accordance with the present invention comprises a housing 10 defining a receiving space 11 for electrically receiving a complementary plug connector therein (not shown). The housing 10 further defines a pair of slots 12 at a top surface 10*a* thereof for detachably receiving a pair of light emitting diodes 13 therein. The housing 10 further defines a pair of retaining recesses 14 in a bottom wall 10*b* thereof and a pair of cutouts 15 on sidewalls 10*c* thereof.

A terminal insert 20 is arranged to the housing 10 and includes a plurality of terminals 21 integrally formed thereof. Each terminal 21 includes a contact portion 21*a* extending into the receiving space 11 when the insert 20 is assembled to the housing 10. Each terminal 21 further includes a solder tail 21*b* extending downward from a bottom face of the insert 20.

The anti-incorrect-insertion device 40 is arranged in the receiving space near an entrance 11*a* thereof and blocks insertion of other connectors except the complementary plug connector.

The device 40 includes a base 41 with a pair of fangs 42 extending rearward from the base 41. The fangs 41*a* can be snugly received in the retaining recesses 14 of the housing 10. The base 41 further includes a pair of wings 41*b* extending transversely thereof. A blocking bar 42 is pivotably attached to the base 41 by a pair of resilient hinges 43 and which includes inclined surfaces 43*a* thereof. The hinges 43 are distant with a distance D from inner walls of the hinges 43. The blocking bar 42 includes a front face 42*a* being perpendicular to the base 41.

The blocking bar 42 further includes a pair of tabs 44 extending rearward therefrom. Each tab 44 includes an inclined portion 44*a* for further depressed by the inserted complementary connector.

In order to prevent the blocking bar 42 from being broken apart during a force entry, the blocking bar 42 defines a passage 42*b* lengthwise and in which a reinforced metal bar 45 is fixedly disposed therein. By this arrangement, the rigidity of the blocking bar 42 is largely increased to effectively block the insertion of the incorrect plug connector, such as the RJ-11 plug connector.

Figure 4:
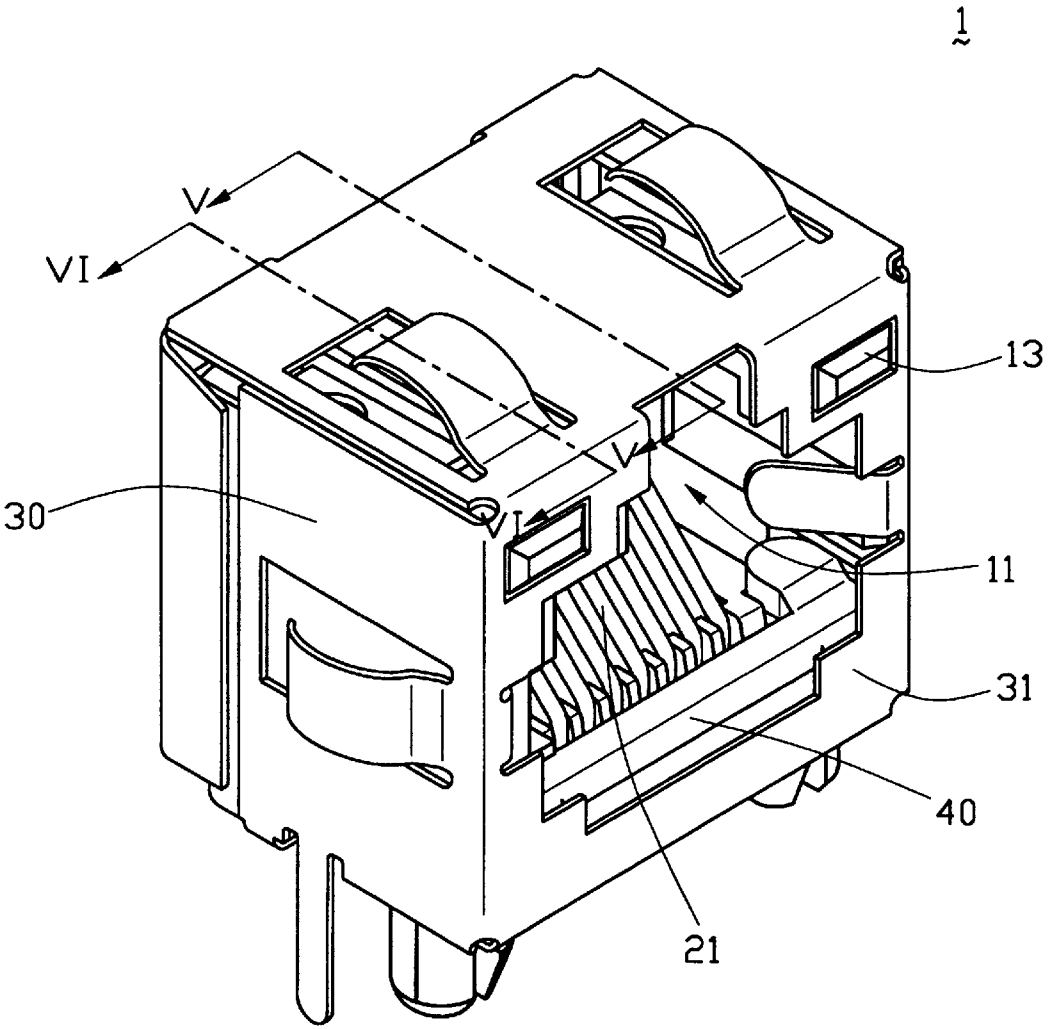
FIG. 4 is an assembled view of FIG. 1.

As shown in FIGS. 1 and 4, the housing 10 can be further enclosed by a shell 30. When the shell 30 is assembled to the housing 10, the wings 41*b* are enclosed by front wall 31 of the shell 30 thereby prevent the device 40 from escaping from the receiving space 11.

Figure 5:
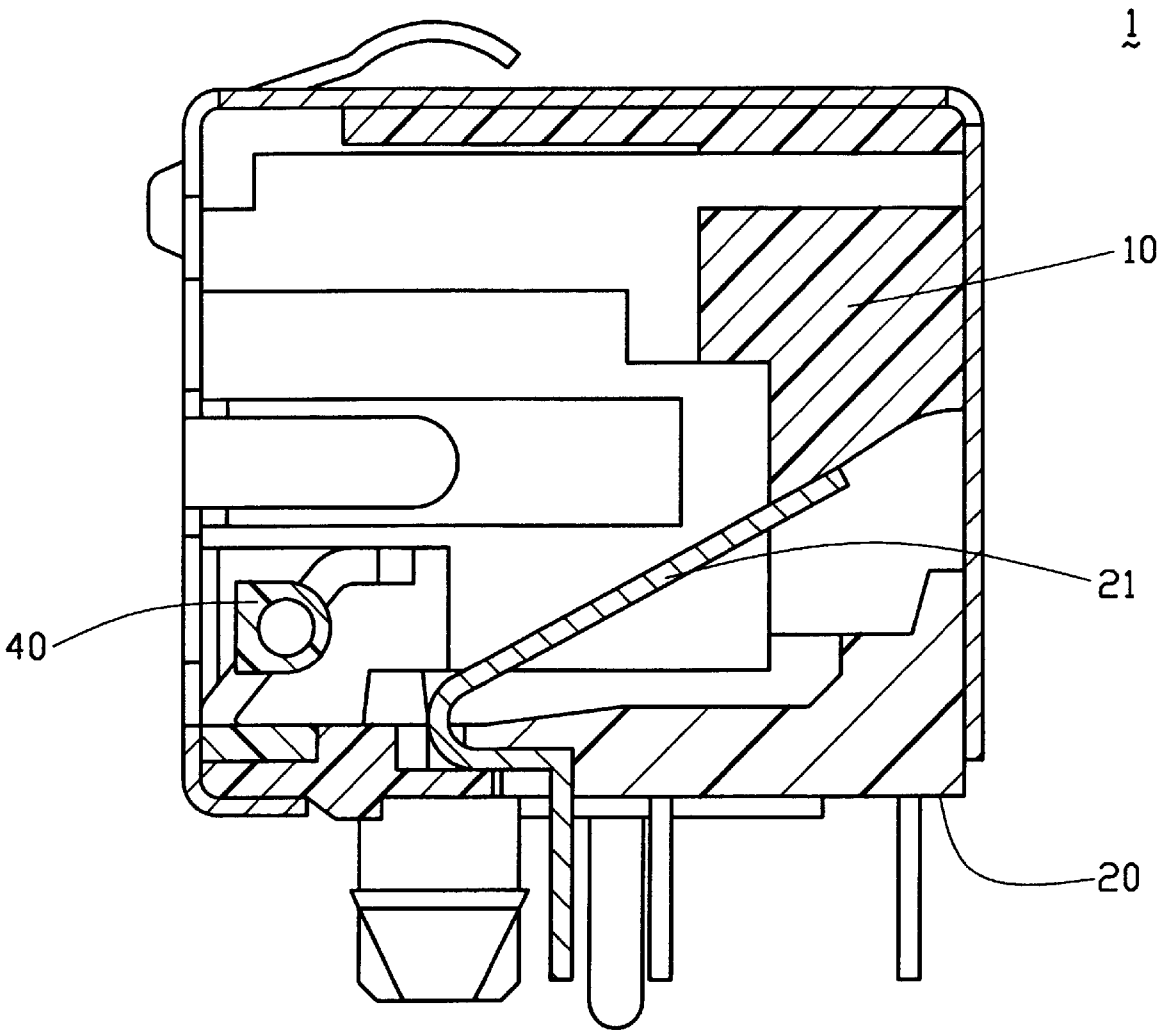
FIG. 5 is a cross sectional view taken along line V—V of FIG. 4.
Figure 6:
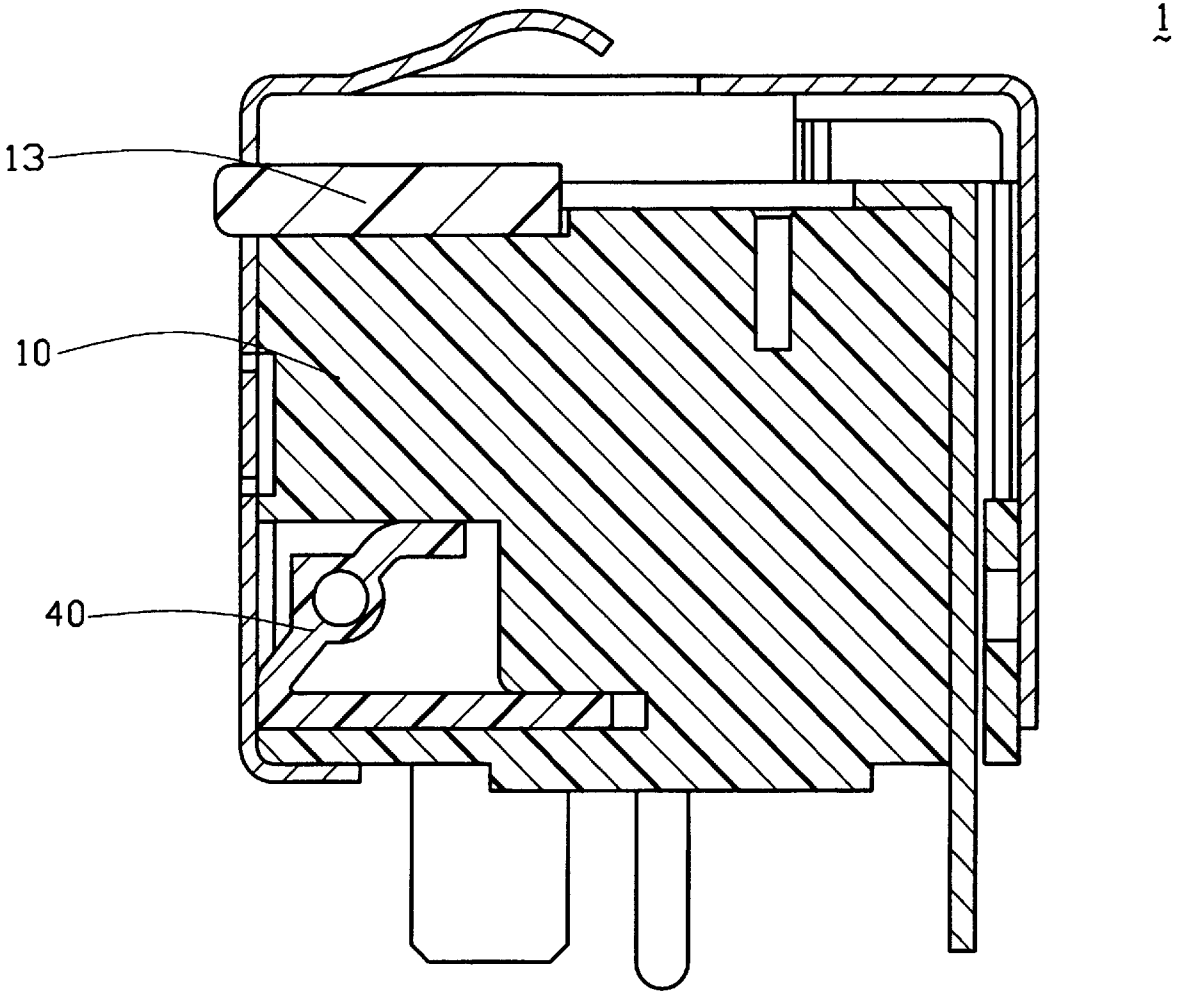
FIG. 6 is a cross sectional view taken along line VI—VI of FIG. 4.

FIGS. 5 and 6 disclose cross sectional views of the connector 1 taken along lines V—V and VI—VI thereof.

As clearly shown in FIGS. 5 and 6, when the device 40 is assembled into the receiving space 11, the height of the entrance 11*a* is properly reduced. In addition, since the hinges 43 is paced apart from each other and when the RJ-11 plug connector is inserted, the RJ-11 plug connector is blocked by the front face 42*a* of the blocking bar 42 because the width of the RJ-11 plug connector is smaller than the distance between the resilient hinges 43. As a result, the RJ-11 plug connector can never be inserted into the RJ-45 receptacle connector 10 as a lower portion of the RJ-45 plug connector is exactly blocked by the locking bar 42.

While when a RJ-45 plug connector is inserted into the receiving space 11, as the width of the RJ-45 plug connector is wider enough such that during the insertion, a lower edge of the RJ-45 connector will abut against the inclined surfaces 43*a* of the hinges 43 such that the front face 42*b* is tilted to become an inclines surface. As a result, the lower edge of the RJ-45 plug connector can easily slide over and moves further into the receiving space 11. It can be noted that one feature of the invention is to provide anti-mismating mechanism around the entrance of the receptacle connector, which defines a relative larger dimension to comply with the receptacle connector and the corresponding plug connector, and is only actuated by the correct corresponding plug under either deflection, rotation or retraction to expose the inner receiving space for mating. In opposite, the incorrect plug connector having the smaller dimension thereof is not able to actuate such mechanism and then will be blocked out. Generally speaking, as mentioned before the invention is to provide anti-incorrect-insertion device for preventing incorrect insertion of any other connectors except the correct complementary connector.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. A RJ-receptacle connector with anti-incorrect-insertion device, comprising:

a housing defining a receiving space for electrically receiving a complementary plug connector therein;

a plurality of terminals disposed in the housing, each terminal including a contact portion extending into said receiving space, and a solder tail extending downward from a bottom face of said housing; and anti-incorrect-insertion means arranged in an entrance of said receiving space and blocking insertion of other connectors except the complementary plug connector;

wherein said blocking bar is pivotably attached to said base by a pair of hinges;

wherein each of said hinges includes an inclined surface such that said blocking bar is rotated downwardly when said inclined surface is pushed backward by the complementary plug connector;

wherein said hinges are distant from each other such that said inclined surfaces will not be physically engaged by a plug connector other than said complementary plug connector;

wherein said blocking bar includes a front face being perpendicular to said base;

wherein a pair of tabs extends rearwardly from said blocking bar, each tab including an inclined portion for being further depressed by said inserted complementary plug connector;

wherein said base includes a pair of fangs physically engaged in corresponding recesses defined in said housing;

wherein said base includes a pair of wings physically retained by cutouts defined in said receiving space;

wherein said blocking bar defines a passage therethrough and in which a reinforced bar is fixedly disposed therein.

* * * * *